US006514775B2

(12) United States Patent
Chen et al.

(10) Patent No.: US 6,514,775 B2
(45) Date of Patent: Feb. 4, 2003

(54) IN-SITU END POINT DETECTION FOR SEMICONDUCTOR WAFER POLISHING

(75) Inventors: Haiguang Chen, Millbrae, CA (US); Shing Lee, Fremont, CA (US)

(73) Assignee: KLA-Tencor Technologies Corporation, Milpitas, CA (US)

( * ) Notice: Subject to any disclaimer, the term of this patent is extended or adjusted under 35 U.S.C. 154(b) by 0 days.

(21) Appl. No.: 10/008,935

(22) Filed: Nov. 9, 2001

(65) Prior Publication Data

US 2003/0003605 A1 Jan. 2, 2003

Related U.S. Application Data

(60) Provisional application No. 60/301,894, filed on Jun. 29, 2001.

(51) Int. Cl.[7] ..... H01L 21/00; G01R 31/26; B24B 49/00; B24B 51/00

(52) U.S. Cl. ..... 438/8; 438/16; 438/692; 451/6

(58) Field of Search ..... 438/8, 14, 15, 438/16, 17, 18, 692; 451/6, 287

(56) References Cited

U.S. PATENT DOCUMENTS

| | | | | |
|---|---|---|---|---|
| 4,306,835 | A | 12/1981 | Hurley | 415/118 |
| 4,672,196 | A | 6/1987 | Canino | 250/225 |
| 4,710,030 | A | 12/1987 | Tauc et al. | 356/432 |
| 4,778,995 | A | 10/1988 | Kulpinski et al. | 250/327.2 |
| 5,042,951 | A | 8/1991 | Gold et al. | 356/369 |
| 5,081,796 | A | 1/1992 | Schutlz | 51/165.74 |
| 5,159,412 | A | 10/1992 | Willenborg et al. | 356/445 |
| 5,166,752 | A | 11/1992 | Spanier et al. | 356/369 |

(List continued on next page.)

FOREIGN PATENT DOCUMENTS

| | | |
|---|---|---|
| EP | 0738561 A1 | 10/1996 |
| EP | 0824995 A1 | 2/1998 |
| EP | 0881040 A2 | 12/1998 |
| EP | 0881484 A2 | 12/1998 |
| EP | 0886184 A2 | 12/1998 |
| EP | 0886184 A3 | 12/1998 |
| EP | 0890416 A2 | 1/1999 |
| WO | WO 95/18353 | 7/1995 |
| WO | WO 98/05066 | 2/1998 |
| WO | WO 99/02970 | 1/1999 |
| WO | WO 99/23449 | 5/1999 |

OTHER PUBLICATIONS

Mehrdad Nikoonahad, Shing Lee, and Haiming Wang, *"Non–Contract System for Measuring Film Thickness"*, U.S. Patent Application Serial No. 09/028,417, filed Feb. 24, 1998, p. 43.

Berman, et al., "Review of In Situ & In–line Detection for CMP Applications", Semiconductor Fabtech — 8$^{th}$ Edition, *www.fabtech.org*, pp. 1–8.

Bibby, et al., "Endpoint Detection for CMP", Journal of Electronic Materials, vol. 27, No. 10, Received Mar. 30, 1998, Accepted Jun. 24, 1998, pp. 1073–1081.

*Primary Examiner*—Olik Chaudhuri
*Assistant Examiner*—Timothy Sutton
(74) *Attorney, Agent, or Firm*—Beyer Weaver & Thomas LLP

(57) ABSTRACT

The present invention relates to in-situ techniques for determining process end points in semiconductor wafer polishing processes. Generally, the technique involves utilizing a scanning inspection machine having multiple pair of lasers and sensors located at different angles for detecting signals caused to emanate from an inspected specimen. The detection techniques determine the end points by differentiating between various material properties within a wafer. An accompanying algorithm is used to obtain an end point detection curve that represents a composite representation of the signals obtained from each of the detectors of the inspection machine. This end point detection curve is then used to determine the process end point. Note that computation of the algorithm is performed during the polishing process so that the process end point can be determined without interruptions that diminish process throughputs.

16 Claims, 11 Drawing Sheets

U.S. PATENT DOCUMENTS 5,181,080 A 1/1993 Fanton et al. ..... 356/381
5,196,353 A 3/1993 Sandhu et al. ..... 437/8
5,413,941 A 5/1995 Koos et al. ..... 437/8
5,433,651 A * 7/1995 Lustig et al. ..... 216/88
5,483,568 A 1/1996 Yano et al. ..... 378/44
5,596,406 A 1/1997 Rosencwaig et al. ..... 356/327
5,597,442 A 1/1997 Chen et al. ..... 156/626.1
5,605,760 A 2/1997 Roberts ..... 428/409
5,633,797 A 5/1997 Sandhu ..... 364/424.034
5,643,050 A 7/1997 Chen ..... 451/10
5,647,952 A 7/1997 Chen ..... 156/636.1
5,691,253 A 11/1997 Kobayashi ..... 438/690
5,747,813 A 5/1998 Norton et al. ..... 250/372
5,872,633 A 2/1999 Holzapfel et al. ..... 356/381
5,883,710 A 3/1999 Nikoonahad et al. .... 356/237.2
5,891,352 A 4/1999 Litvak ..... 216/85
5,893,796 A 4/1999 Birang et al. ..... 451/526
5,899,792 A * 5/1999 Yagi ..... 451/287
5,900,633 A 5/1999 Solomon et al. ..... 250/339.08
5,910,842 A 6/1999 Piwonka-Corle et al. ... 356/364
5,910,846 A 6/1999 Sandhu ..... 356/381
5,911,619 A 6/1999 Uzoh et al. ..... 451/5
5,936,733 A 8/1999 Sandhu et al. ..... 356/357
6,071,177 A * 6/2000 Lin et al. ..... 156/345.13
6,287,879 B1 * 9/2001 Gonzales et al. ..... 438/16
6,361,646 B1 * 3/2002 Bibby et al. ..... 216/85

* cited by examiner

Three Dimensional Data Array

IN-SITU END POINT DETECTION FOR SEMICONDUCTOR WAFER POLISHING

CROSS-REFERENCE TO RELATED APPLICATIONS

This application claims priority of U.S. provisional patent application No. 60/301,894, filed Jun. 29, 2001, which is hereby incorporated by reference.

This application is also related to U.S. patent application Ser. No. 09/396,143, filed Sep. 9, 1999, entitled "APPARATUS AND METHODS FOR PERFORMING SELF-CLEARING OPTICAL MEASUREMENTS", the content of which is hereby incorporated by reference.

FIELD OF THE INVENTION

The present invention relates generally to semiconductor wafer polishing, and more specifically to in-situ end point detection in semiconductor wafer polishing processes.

BACKGROUND OF THE INVENTION

One common process used during the fabrication of semiconductor wafers is that of polishing the wafers. Polishing is performed for various reasons that include removing certain layers of material, exposing underlying material layers, and obtaining desired wafer thickness dimensions. Polishing processes are preferably closely monitored so that when a process end point is reached, the polishing is stopped and only the desired amount of material is actually removed from a wafer. Without such monitoring, certain material layers may be undesirably removed or left remaining on the surface of a wafer. Such process errors can ultimately degrade, or even totally prevent, operation of the resulting integrated circuit devices. Monitoring and controlling polishing processes is difficult because there are many factors, such as the condition of the polishing pad, characteristics of the slurry chemistry, the thickness of the films in the incoming wafer, and the circuit pattern density. These exemplary factors affect the time required to polish semiconductor wafers.

Semiconductor polishing is even more challenging when the physical and chemical properties of the layers in a semiconductor film structure are similar. When this is the case, it is difficult for measurement sensors to detect the processing end point at which one layer of material has been removed and next layer has been exposed. This, for example, is the case with shallow trench isolation (STI) wafers. STI wafers have multiple non-metal layers. Since it is difficult to differentiate between certain physical properties of these non-metal layers using various sensors, it is easy to either over or under polish STI wafers. Commonly, STI wafers are polished using chemical mechanical polishing techniques (CMP).

Generally, semiconductor wafer polishing control techniques can be divided into two categories. One category requires the interruption of the polishing process to remove wafers to be inspected. The other category pertains to in-situ measurement where the wafers can be inspected during the polishing process without process interruption.

A widely used method to control a semiconductor wafer polishing process is the polishing-time based method, which uses fixed polishing times determined from the polishing results of test wafers. Interruption of the polishing process is required in order to access and inspect the test wafers. Unfortunately, the interruption required to measure the test wafers requires extra processing time, thereby reducing production throughput and overall process efficiency. Also, the polishing-time based method cannot effectively handle the changing polishing conditions and the variations in the film thickness of incoming wafers, and thus often produces over or under polished results.

In-situ measurement techniques generally provide better process efficiency, however, not without its own specific performance disadvantages. Exemplary in-situ polishing measurement techniques include motor current and carrier vibration techniques. However, these techniques have disadvantages such as the inability to provide planarization information in different wafer areas and ineffectiveness for certain wafer types, such as shallow trench isolation wafers.

In view of the foregoing, improved in-situ semiconductor wafer polishing control techniques would be desirable.

BRIEF SUMMARY OF THE INVENTION

The present invention relates to in-situ techniques for determining process end points in semiconductor wafer polishing processes. Generally, the technique involves utilizing a scanning inspection machine having multiple lasers and multiple detectors for detecting signals caused to emanate from an inspected specimen. The detection techniques determine the end points by differentiating between various material properties within a wafer. An accompanying algorithm is used to obtain an end point detection curve that represents a composite representation of the signals obtained from each of the detectors of the inspection machine. This end point detection curve is then used to determine the process end point. Note that computation of the algorithm is performed during the polishing process so that the process end point can be determined without interruptions that diminish process throughputs.

One aspect of the present invention pertains to a method for determining a process end point during a semiconductor wafer polishing process, using a measurement system having multiple lasers and detectors pairs that are located at different angles. The method involves repeating a monitoring cycle that includes the sequential execution of directing, measuring, recording, and determining operations. The directing operation involves directing a group of beams of radiation to be incident upon a semiconductor wafer. The reflecting light from each of the lasers is detected with a respective one of the sensors. The use of multiple sensors at different angles can effectively reduce the range of the signal intensity change during the polishing of the top oxide layer of STI wafer and thus make the end point detection at a nitride layer more reliable. The frequency of each of the measured reflectance values from multiple sensors is recorded in a two dimensional histogram. Then the average reflectance value representing the reflectance value that was most frequently measured by the sensors is determined from the histogram. The average reflectance values are fitted to a low order polynomial to form the averaged reflectance curve. The use of average reflectance values can produce a representing curve less sensitive to the circuit patterns on wafers and to other measurement noise. A non-symmetric hat function is created to provide a dynamically updated reference curve, which incorporates the properties of reflectance transitions at the interfaces between different layers of materials when polishing wafer. The process end point is identified when the average reflectance values substantially begin to deviate from the reference curve.

These and other features and advantages of the present invention will be presented in more detail in the following specification of the invention and the accompanying figures, which illustrate by way of example the principles of the invention.

BRIEF DESCRIPTION OF THE DRAWINGS

The invention, together with further advantages thereof, may best be understood by reference to the following description taken in conjunction with the accompanying drawings in which.

DETAILED DESCRIPTION OF THE INVENTION

The present invention will now be described in detail with reference to a few preferred embodiments thereof as illustrated in the accompanying drawings. In the following description, numerous specific details are set forth in order to provide a thorough understanding of the present invention. It will be apparent, however, to one skilled in the art, that the present invention may be practiced without some or all of these specific details. In other instances, well known operations have not been described in detail so not to unnecessarily obscure the present invention.

The present invention relates to in-situ techniques for determining process end points in semiconductor wafer polishing processes. Determining process end points accurately prevents the wafers from being over or under polished. Generally, the technique involves utilizing a scanning inspection machine having multiple lasers and sensors for detecting signals caused to emanate from an inspected specimen. The detection techniques determine the end points by differentiating between various material properties within a wafer. An accompanying algorithm is used to obtain an end point detection curve that represents a composite representation of the signals obtained from each of the detectors of the inspection machine. This end point detection curve is then used to determine the process end point. Note that computation of the algorithm is performed during the polishing process so that the process end point can be determined without interruptions that diminish process throughputs. The techniques of the present invention are particularly useful when polishing wafers containing film layers that have similar material properties, such as shallow trench isolation (STI) wafers. A higher level of accuracy and sensitivity for detecting inspection signals is required since the reflectance signals from non-metal layers have lower intensity than metal layers and the difference in signal values is smaller for similar materials. By utilizing multiple lasers and detectors to obtain a composite end point detection curve, greater sensitivity and stability in signal detection can be obtained in these more challenging scenarios.

The disclosure will describe the inventive techniques by first describing an exemplary polishing and inspection machine that can be used to implement the invention. Then, a portion of a wafer film structure that is typically polished and its respective inspection signals are illustrated. Then the disclosure will describe the algorithm for determining the process end point.

Figure 1:
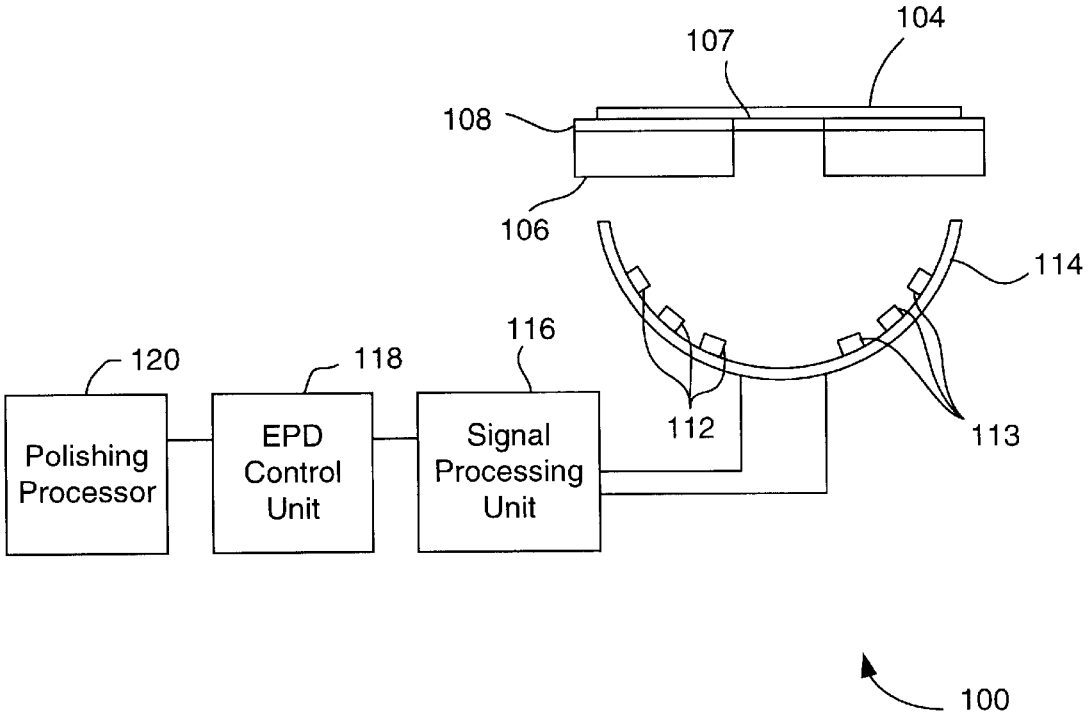
FIG. 1 illustrates a diagram of an exemplary polishing and inspection system in which the technique of the present invention can be utilized.

FIG. 1 illustrates a diagram of an exemplary polishing and inspection system 100 in which the technique of the present invention can be utilized. The polishing and inspection system 100 has a palette 106, a pad 108 with a transparent window 107 in the middle, a set of photon emitters or lasers 112 and a set of detectors 113 set at different angles surrounding the wafer 104, a signal processing unit 116, an end point detection processing unit 118, and a polishing processor 120. The semiconductor wafer 104 is supported by a carrier (not shown).

The lasers 112 direct light beams towards the semiconductor wafer 104. During polishing processes, the pad 108 that is on the top surface of the platen 106 typically is covered with slurry material. Typically, the carrier and the platen 108 are rotated relative to each other to polish the wafer 104. Water is made to flow over the region of the semiconductor wafer 104 beneath the transparent window 107 so that an unobstructed path through the slurry is provided for the lasers 112 and the detectors 113 to obtain accurate reflectance measurements. The technique of clearing the inspected region on the wafer 104 is preferrable, however, optional. Inspection of the wafer 104 is possible without clearing the wafer surface, however, the measurements will typically be less accurate. Mechanisms, capable of clearing a wafer of distorting particles and slurry during a polishing process by using a fluid, such as water, has been disclosed in U.S. patent application Ser. No. 09/396,143, which is incorporated herein. Alternative embodiments of the inspection system 100 capable of clearing the polished wafer of debris and slurry during the polishing process can be used with the inspection technique of the present invention.

The lasers 112 and the detectors 113 are positioned about the wafer 104 in a hemispherical arc. The lasers 112 and the detectors 113 are grouped in matching pairs such that each of the detectors 113 are positioned to detect light reflected off the wafer 104 due the transmitted light from a specific one of the lasers 112. Each of the laser/detector pairs are set a different angle with respect to the surface of the wafer 104 so that different signals can be detected. As will be described in more detail below, the various sets of signals obtained from each pair of lasers and detectors will be used together to obtain a more accurate indication of a polishing process end point as compared to the situation when only one laser/detector pair is used. In other words, the difference between the signals from each of the pair of lasers and detectors can provide important wafer structure information.

The structure 114 supporting the lasers and detectors can be any of a variety of structures capable of providing supporting. The height and azimuth angle at which the sensors 112 are positioned can vary depending upon the parameters involved with each specific polishing process.

The signal-processing unit 116 receives signals from the laser 112 and detector 113 pairs and directs the signals to the end point detection control unit 118. In some embodiments of the present invention, it is common for the signal-processing unit 116 to convert the analog signals received by the sensors 112 into digital signals and perform the necessary signal processing. The signal-processing unit 116 also controls signals to the light source 102.

The end point detection (EPD) control unit 118 is in communication with both the signal processing unit 116 and the polishing processor 120. The EPD control unit 118 runs an algorithm designed to use the signals collected by detectors 112 in order to determine the end point for the polishing process. EPD control unit 118 is connected to the polishing processor 120 so that the end point detection control unit 118 can control the polishing of the wafer 104. For instance, when it is determined that an end point has been reached, the end point detection control unit 118 will transmit a signal to the polishing processor 120 to stop polishing of the wafer 104. The algorithm for determining the end point will be describe in more detail below.

In a preferred embodiment of the invention, the detection system determines the end point by differentiating between the intensity of the reflective light of the two different film layers. Determining the value and therefore the difference between metal layers and non-metal layers is simpler because metal has high reflectivity. However, it is difficult to differentiate reflectance values of other non-metal materials such as oxides. This is because materials such as oxides and nitrides have reflectivity values that are relatively close in value to each other. In order to obtain a more accurate reflectance measurement of the wafer, it is preferable to have six or more detectors 112 positioned about a polished wafer. Practically, the physical space constraints will present a limit as to how many detectors can be placed within a polishing system. Also, when too many sensors are used, it becomes difficult to physically install and electronically control the sensors, and more difficult to process the collected information.

This invention is particularly useful for shallow trench isolation type (STI) wafers since these commonly have oxide and nitride layers that need to be differentiated during chemical mechanical polishing (CMP). This invention can be used for various wafer types containing materials with similar reflectance values.

Figure 2:
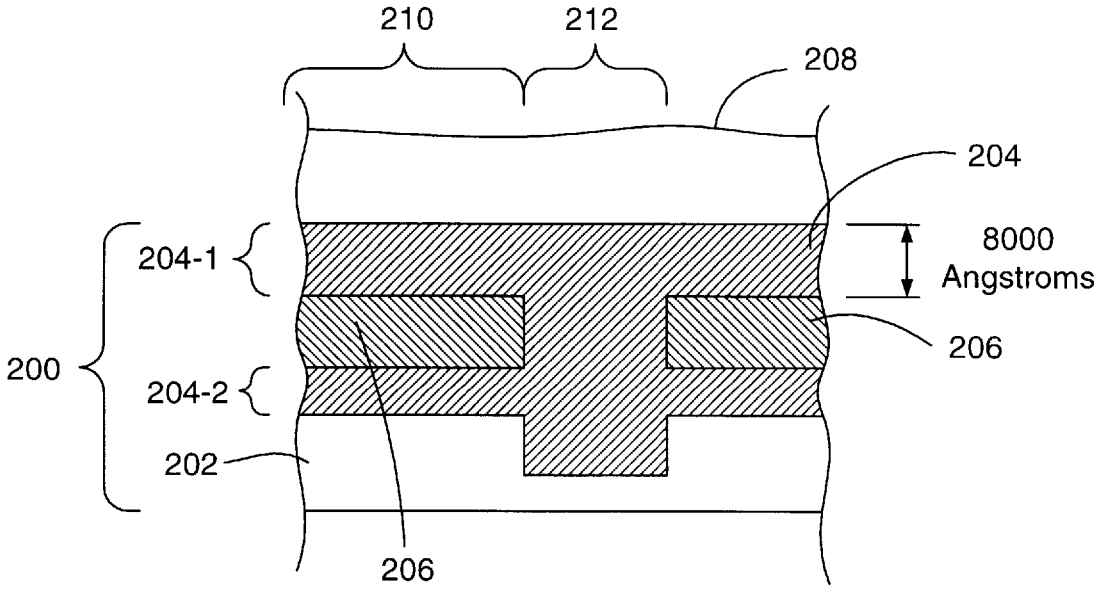
FIG. 2 illustrates a side plan, cross-sectional view of an exemplary wafer film structure to be polished.

The inspection system detects reflectance values from the wafer during each mechanical polishing cycle or during each set time interval in order to monitor the progress of the chemical mechanical polishing process. The inspection system typically utilizes each of its multiple sensors to take reflectance value measurements along multiple measurement spots along a path of the wafer su The path should cover areas that are representative of the different areas on a wafer such that an average reflectivity value can be generated. The different areas may be characteried by the types of materials, the types of circuitry, or the ability of the polishing process to effectively polish a specific area of a wafer. One typical path taken by a scanning apparatus moves the radiation beam across the wafer in a V-shaped pat In this V-shaped path, many measurement spots are selected at which to take reflectance values. For example, three hundred measurement spots can be within a measurement path. It should be understood t some of the three hundred spots may not actually fall on the surface of the wafer. Due to the possibility of slight variations in wafer positioning, the first and last few measurement positions might actually fall off the edges of the wafers. These excess measurement spots are required due to the uncertainty of the wafer positions and are useful in determining the signal background information. These measurements values acquired out of the wafer edges will be disregarded when evaluating reflectance values. The number of measurement spots can vary deeding on the required sensitivity of measurements, and the size of the wafer to be inspected FIG. 2 illustrates a side plan, cross-sectional view of an exemplary wafer film 200 to be polished. The film structure 200 includes a silicon substrate 202, a silicon oxide layer 204, and deposits of a silicon nitride 206. To polish the top surface of the wafer 200, a slurry 208 is applied to the top surface. A typical polishing process would the upper layer 204-1 of the silicon oxide layer 204 to be removed such that t he silicon nitride deposits 206 become exposed In FIG. 2, the upper layer 204-1 happens to have a depth of 800 nm The end point detection techniques of the present invention are aimed to stop the polishing process when the upper layer 204-1 is removed and very little of the silicon nitride deposits 206 are removed.

Light beams directed at the film structure from a light source cause a spot to be illuminated upon the top surface of the wafers. This spot of light covers an area to be inspected by the inspection system This spot of light can fall upon three distinct vertical sections of the film structure 200, with respect to end point detection purposes. The first vertical section consists entirely of a vertical section having the upper layer of silicon oxide 204-1, a deposit of silicon nitride 206, and the bottom layer of silicon oxide 204-2. This vertical section of the wafer is called a waylayer region 210 in this invention. At other times, the spot of light will fall entirely on the vertical section of the film structure 212 that includes the via of silicon oxide. This section is referred to as the one-layer region 212. Finally, the spot can fall upon a vertical section of the film structure made up of a combination of a portion of the three-layer region 210 and a portion of the one-layer region 212. The percentage make up of this combination region depends upon where the spot falls on the film structure 200.

Figure 3:
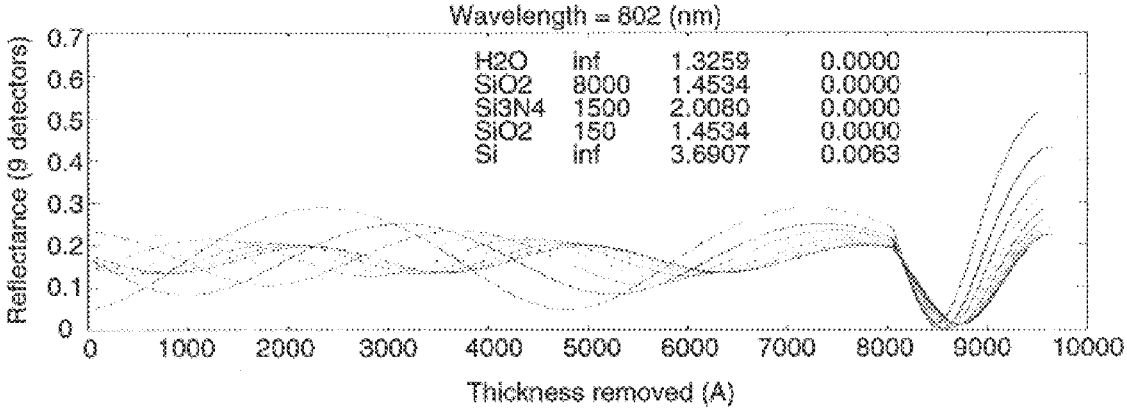
FIG. 3 represents the reflectance values obtained at a single three-layer region by nine individual optical detectors.
Figure 4:
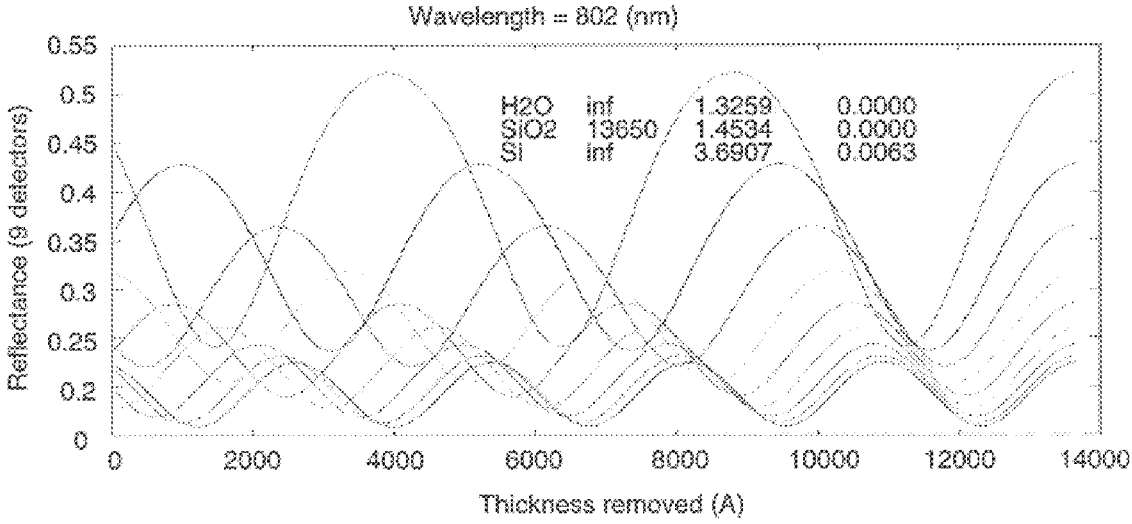
FIG. 4 illustrates the reflectance values at the one layer region of silicon oxide.

FIGS. 3–5 plot the reflectance values detected versus the thickness of the upper layer of silicon oxide 204-1 as it is removed during a polishing process. The vertical axes represent the reflectance values and the horizontal axes represent the thickness of the silicon oxide that is removed.

FIG. 3 represents the reflectance values obtained at a single three-layer region by nine individual optical detectors. It can be seen that the reflectance values for each sensor fluctuates about an average reflectance value because the beam penetrates multiple layers at each polishing depth. Each of these layers reflects energy back to the sensors at a slightly different intensity and phase, and therefore, the final reflectance value acquired by the sensors fluctuates as the polishing progresses through the various layers. Until the depth of 8000 Angstroms, the reflectance values fluctuate about respective average values. At about the depth of 8000 Angstroms, it can be seen that the collective behavior of the reflectance curves changes. The signals from different sensors begin to converge and then fluctuate about different reflectance values with different amplitudes. This is due to the fact that at 8000 Angstroms, the polishing has progressed to the point that the inspecting light beam becomes incident upon the silicon nitride deposit 206. At the end point, the each of the detectors 113 begin to detect different reflectance curves due to the new material that is exposed. The present invention basically identifies the end point for polishing process by identifying the depth at which the reflectivity curves change behavior. This change in behavior is indicated by a simultaneous change in slope of the reflectance curves detected by each of the detector/laser pairs. Depending upon the specific geometry of the film structure being polished, each of the various curves may simultaneously change in slope at a common reflectance value. In this case, the curves seem to converge upon a single point, and then travel together in either a upward or downward direction. The respective reflectivity curves will either travel simultaneously upward or downward depending upon factors such as the phase of the curves and the materials of the film structure being polished. By tracking the reflectance curves during a polishing process, it will be possible to detect the endpoint in an in-situ manner. This will be described further below.

In order for the present invention to work properly, there must be a sufficient difference in reflectance values of the oxide layers such that the detectors are capable of differentiating the different values. Otherwise, the change in reflectance curve behavior would be so minimal that a difference would be difficult to detect. The larger the difference, the easier it is to detect a difference. The present end point detection system can be used to detect end points in various film structures having various material layers that have sufficiently different reflectance values.

It is noted that different materials have reflectivity curves that fluctuate about different amplitudes and different mean values. For example, the detection of reflectivity for metals during a progressive polishing process would show very low variance in the reflectivity values and a very sharp change in the reflectivity curve at the end point where metal is removed, since the reflectance for metals is very high.

FIG. 4 illustrates the reflectance value at the one layer region 212 of silicon oxide. Since the vertical section of the film structure 212 is completely formed of silicon oxide, the multiple reflectance curves will fluctuate about the same average values with the same amplitudes regardless of the depth of polishing. Of course, the reflectance value would change if polishing were continued until the silicon substrate were exposed 202.

Figure 5A:
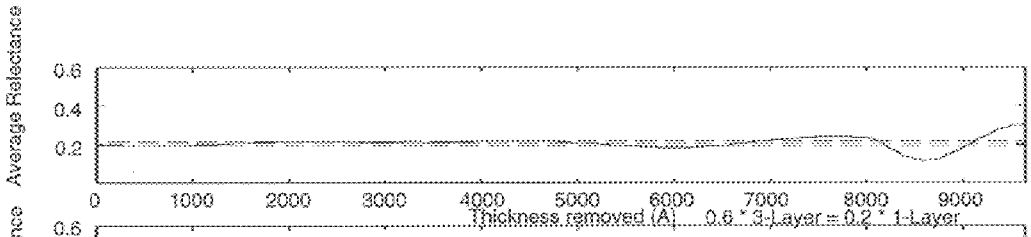
FIGS. 5A and 5B each illustrate a reflectance curve that represents the average of the values obtained by each of the nine detectors versus the depth of polishing in two different combination vertical sections.
Figure 5B:
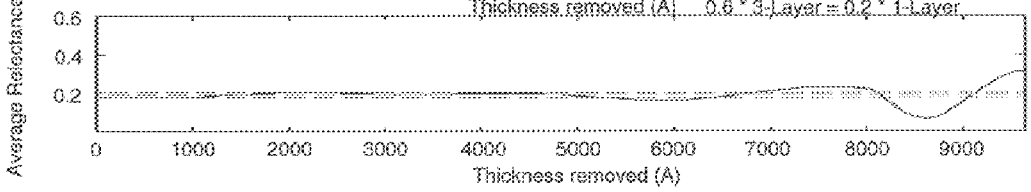

FIGS. 5A and 5B each illustrate a reflectance curve that represents the average of the values obtained by each of the nine detectors versus the depth of polishing in two different combination vertical sections. In FIG. 5A, the signals come from a combination vertical section made up of 60% three-layer region and 40% one-layer region. In FIG. 5B, the signals come from a combination vertical section made up of 80% three-layer region and 20% one-layer region. The change in behavior of the reflectance curves at the depth of 8000 Angstroms is less emphasized than in FIG. 3 since there is no change in oxide layers in the one-layer region of the inspecting spot area. The change in curve behavior is less emphasized in FIG. 5A than in FIG. 5B since the combination vertical section in FIG. 5A has a larger percentage of the one-layer region 112.

As will be further described, the end point detection technique of the present invention will monitor reflectance values during the polishing process at many points on the surface of a semiconductor wafer. These points will be located over one-layer regions, three-layer regions, and combination layer regions. All of these reflectance measurements will be used to generate a composite indicator of the polishing progress or generate several indicators for the different regions of wafer in order to identify the process end point.

Figure 6:
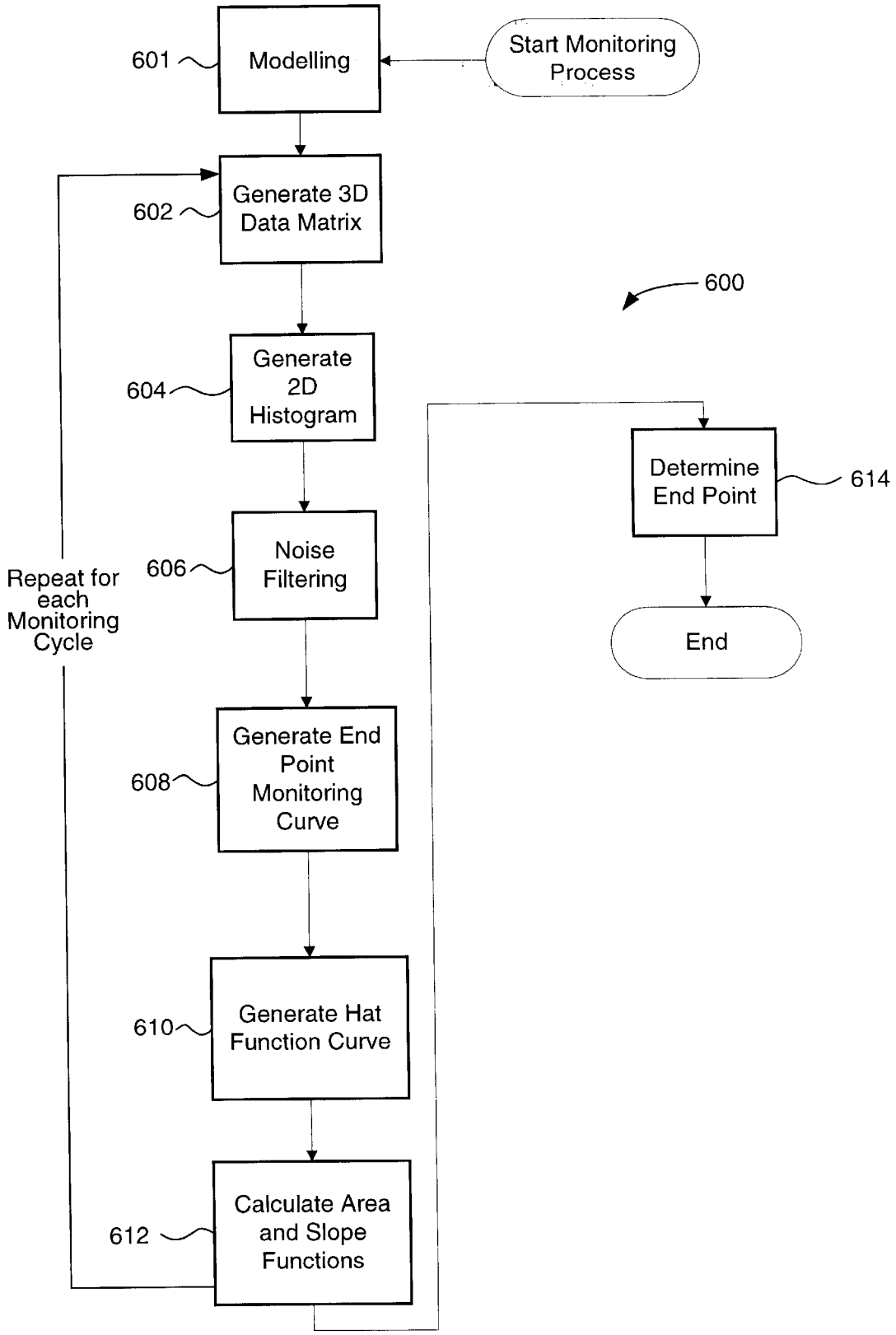
FIG. 6 illustrates a flow diagram of the process end point detection algorithm according to one implementation of the present invention.
Figure 7:
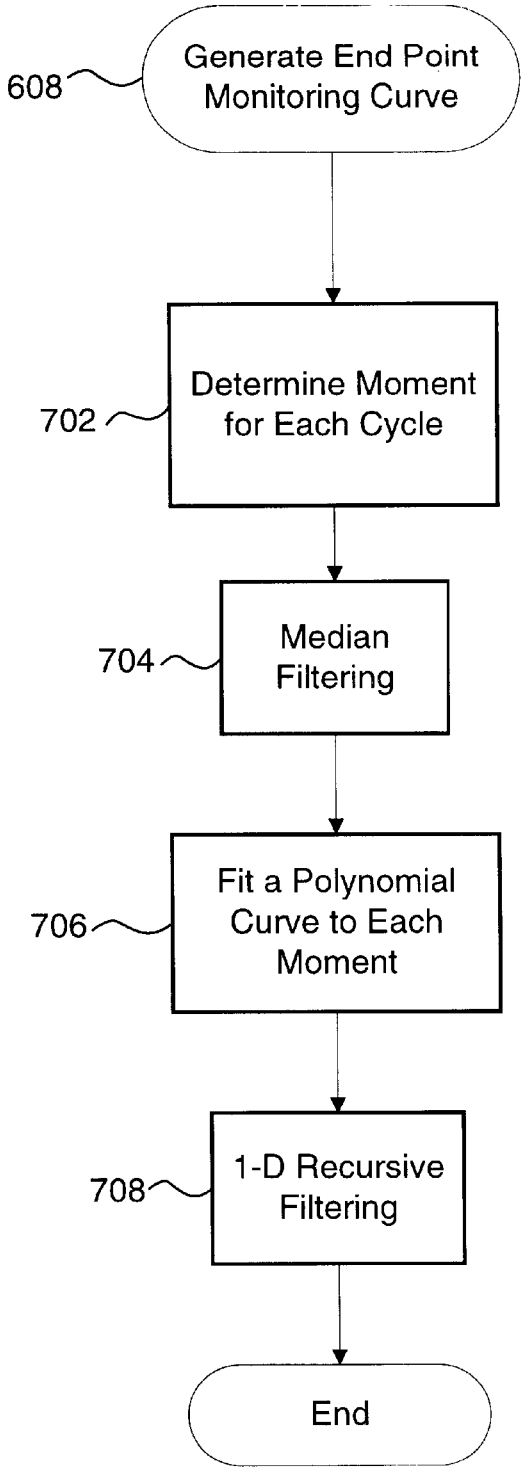
FIG. 7 is illustrates the operations involved with generating an end point monitoring curve.

Now the description of the invention turns to the algorithm used to detect the process end point. FIGS. 6 and 7 illustrate the flow diagrams representing the operations of the algorithm of the present invention for determining the polishing process end point. FIGS. 8–13 will be referenced throughout the explanation of the flow diagrams as examples of the charts generated during the execution of the algorithm.

FIG. 6 illustrates a flow diagram 600 of the process end point detection algorithm according to one implementation of the present invention. The process involves repeated iterations of blocks 602–612 for each cycle in which the inspection of the wafer will be performed. Each monitoring cycle refers to one pass of the inspecting light beam over the surface of a semiconductor wafer. In each pass, reflectance values will be taken at multiple measurement spots on the surface of the wafer by each of a multiplicity of sensors. In some embodiments, one cycle of monitoring corresponds to one cycle of polishing.

The general concept of the end point detection algorithm is to obtain a composite reflectance value that can present some unique features at the interfaces between different material layers and to define some decision rules for the end point reporting. In this invention, the composite reflectance value represents the multiple reflectivity values measured by each of the sensors, at each of the measurement points along the wafer. Such a composite reflectance value represents an average reflectance value from multiple laser and detector pairs for a certain region on the wafer. As can be seen from FIG. 5A and FIG. 5B, a composite reflectance curve mapped against the number of monitoring cycles contains a substantially reduced number of disturbing features as compared to the individual end point monitoring curves. Thus, the stability and accuracy of the end point detection process is greatly improved and the algorithm indicates process end points with less sensitivity to the patterning of wafers. The algorithm can be implemented using C, C++, or any other common computer programming languages.

In preferred embodiments, the process begins at block 601 where modeling processes are used to predict information such as the shapes of the reflectivity curves and the process end points. Information used as input for modeling consists of information such as the geometry of the monitored film structure (e.g., layer thicknesses). Modeling provides information that can help guide the end point detection process. It is noted that the modeling techniques represented in block 601 are optional.

Figure 8:
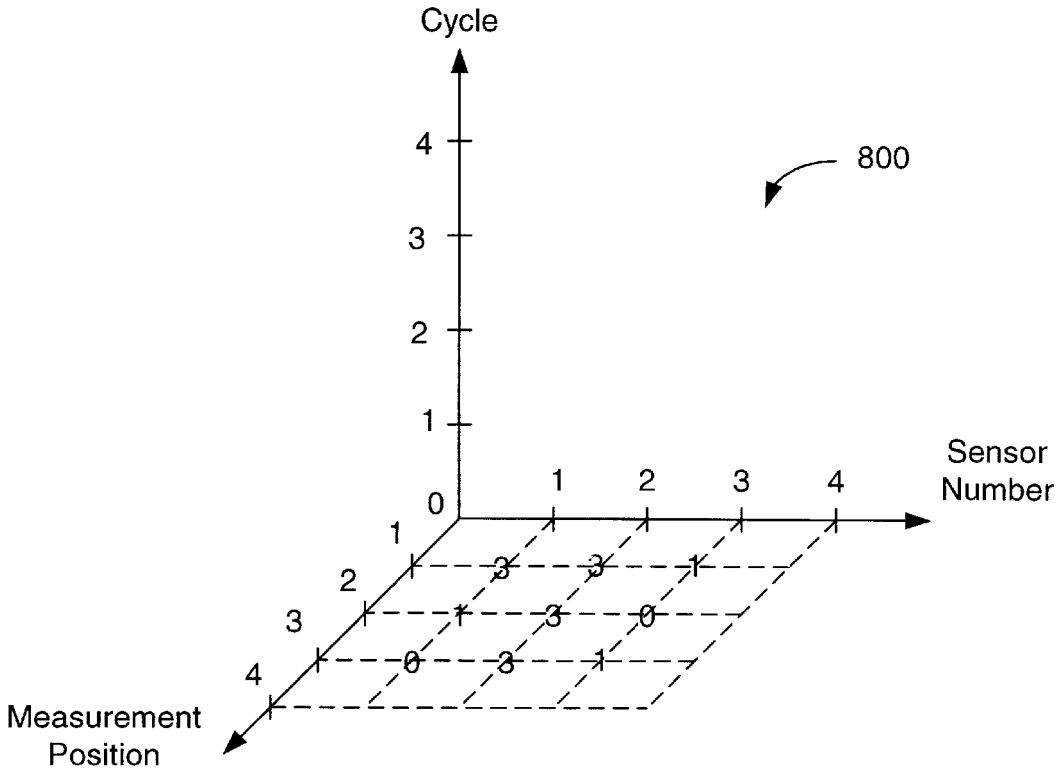
FIG. 8 illustrates an example of a three-dimensional array used by the present invention.

In block 602, data collected after one monitoring cycle is placed in a three-dimensional array. FIG. 8 illustrates an example of a three-dimensional array 800 used by the present invention. The three-dimensional data array for FIG. 8 has three axes. The first axis represents the specific sensors used to collect reflectance values from the semiconductor wafer. The second axis represents each of the various measurement positions along the surface of the wafer at which a reflectance value is measured. The third axis represents the number of monitoring or polishing cycles that have been completed by the polishing/inspection system. Each cycle number contains a respective plane that is filled with measured reflectance values for each measurement position, by each of the sensors. In other words, the three-dimensional array includes the reflectance values for all sensors, at all the wafer inspection positions for each polishing cycle. It is readily understood that the number of sensors, measurement positions, and cycle numbers represented in FIG. 8 are fewer in number than what will probably exist in actual implementations. The scale of 1 through 4 has been selected for explanation purposes only.

A single plane of reflectance values is shown in the plane of cycle number 0, the point at which no polishing has yet begun. In the plane of cycle number 0, it is seen that sensor 1 at position 1 detected a scaled reflectance value of 3. At measurement position 2, sensor number 1 detected a scaled reflectance value of 1. And at measurement position 3, sensor 1 detected a scaled reflectance value of 0. As the end point detection process progresses through the successive number of monitoring cycles, additional reflectance value s will fill each cycle plane.

Figure 9:
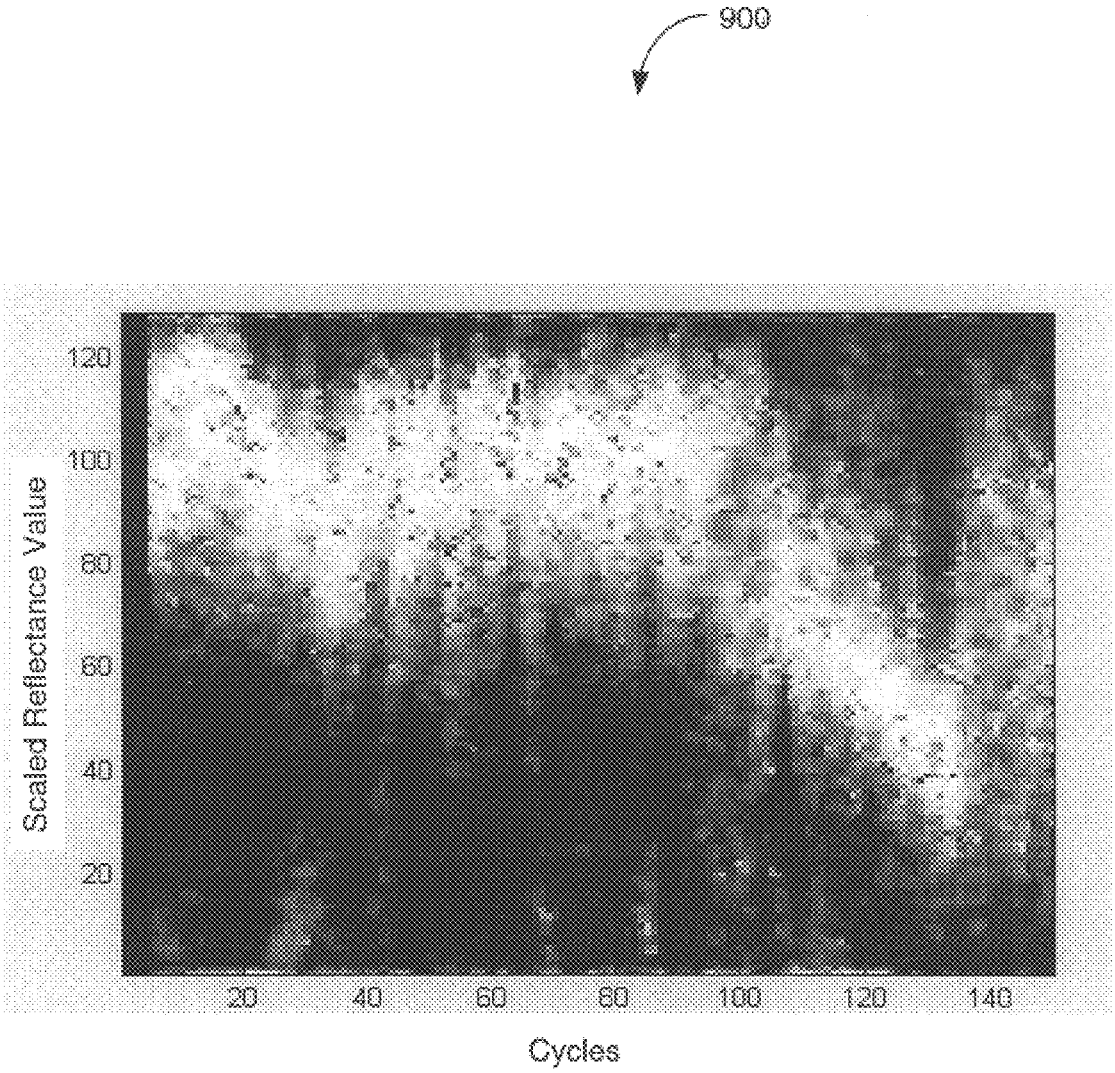
FIG. 9 illustrates a two dimensional histogram generated from the three-dimensional array of FIG. 8.

At block 604 the data in the three-dimensional array is transformed into a two dimensional histogram 900, as represented in FIG. 9. The two dimensional histogram 900 has a horizontal axis representing the number of polishing or monitoring cycles completed by the inspection and polishing system, while the vertical axis represents scaled reflectance values. Represented in the histogram 900 is the frequency of all of the reflectance values measured, by each of the sensors, at each of the measurement positions, for each cycle number. In other words, the two-dimensional histogram 900 represents a composite view of the frequency of the reflectivity measurements at all of the measurement positions on the wafer for all of the individual sensors.

The frequency of each reflectance value is typically shown through a pseudo-color representation. However, since FIG. 9 is represented in black and white, the dark areas represent low to no reflectance frequency, and the lighter areas represent reflectance measurements with high frequencies. A reflectance value at a specific cycle number has a low frequency if it value was detected very few times by each of the detectors, at each of the measurement positions. A reflectance value at a specific cycle number has a high frequency if its value was detected a large number of times by each of the sensors, at each of the measurement positions. In a color representation, the progression from dark to light areas would be analogous, for example, to a progression from blue to green, to yellow to red.

Scaled reflectance values are represented so that the values can easily be placed into bins for analysis techniques. For instance there may by 128 or 256 bins thereby requiring a scaling factor that scales the reflectance values into a range between 0 and 128 or 256. Scaling factors are commonly used in creating histograms.

The histogram 900 illustrates the frequency of reflectance values through about 150 monitoring cycles. It can be seen that a sharp change in reflectance values occurs at around the 100-cycle point. It is around this number of cycles that the process end point lies. The following operations of the algorithm will help identify the end point. It should be understood that during a polishing process, the histogram 900 would be incrementally revealed as the number of monitoring cycles increased. Therefore, the full histogram 900 is illustrated in FIG. 9 would only be available after all 150 monitoring cycles had been completed. Of course, the end point will be located at different points depending upon the type of wafers polished, the specific polishing system and parameters, and other factors.

In block 606, the histogram 900 is run through a noise filter. This step is optional, but usually preferable. Common noise filters such as a Wiener filter, which is especially useful for adaptive noise reduction and image enhancement, can be used. The signal values at low reflectance values and low cycle numbers (at the south-west comer region of FIG. 9) are usually good values to be averaged and used as the noise value in Wiener filtering algorithms. The selected noise value is then consistently used as an input value along with the varying signal values when utilizing Wiener filtering algorithms. As is commonly known, a filtering algorithm generates a more useful curve because it has a higher signal-to-noise ratio and fewer interference features.

Figure 10:
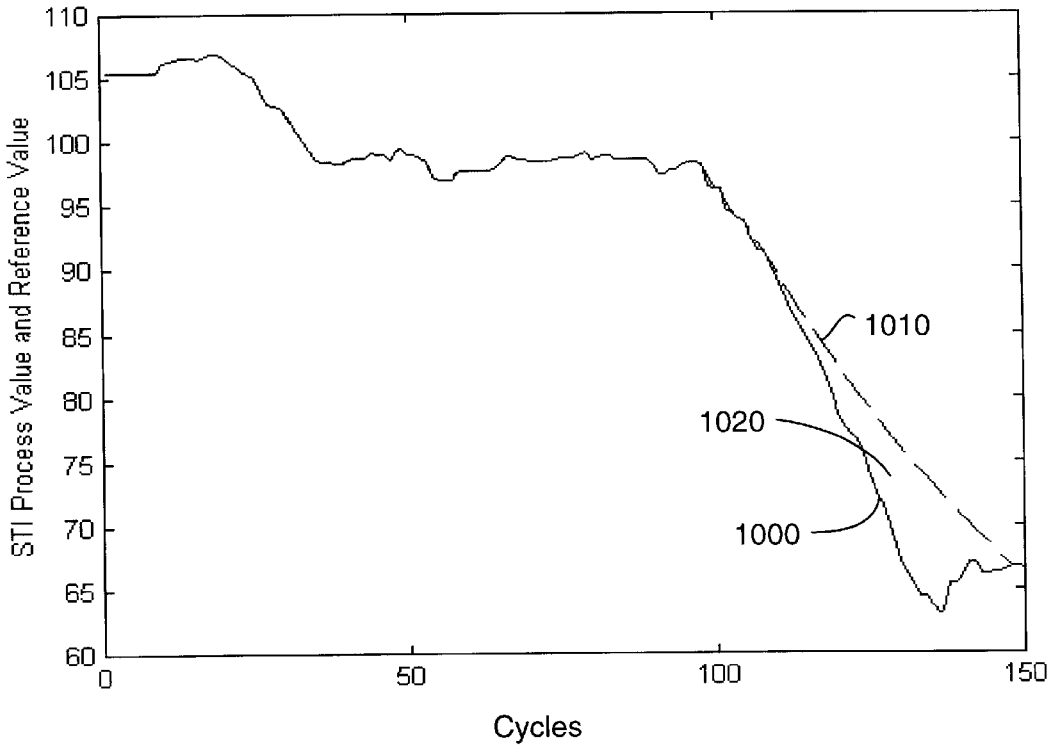
FIG. 10 illustrates an end-point monitoring curve generated from the two-dimensional histogram of FIG. 9.

In block 608, an end point monitoring curve is generated from the histogram of FIG. 9. An end point monitoring curve 1000 is shown in FIG. 10 plotted against a horizontal axis representing the number of monitoring cycles and a vertical axis representing scaled reflectance values. The end point monitoring curve 1000 is an averaged curve based on the frequency of the reflectance values such that a representative reflectance value is selected for each cycle number. The process end point is located approximately where the reflectance curves start to change sharply in slope and/or direction. For example, in FIG. 10, it can be seen that the reflectance values during cycles 50 to 100 fluctuate relatively tightly around 100. However, around 100 cycles, the reflectance values begin decreasing quickly. This drop in reflectance values happens because the polishing process has removed a first layer of material and a second layer of material, having a different reflectance value, is beginning to show through the surface of the wafer. Identifying the point at which the reflectance curve undergoes a substantial change in reflectivity enables the detection of process end points.

Now FIG. 7 is referenced to describe the operations involved with generating an end point monitoring curve. The first operation 702 involves determining the reflectivity moment for each cycle. Basically, this operation finds the most frequently detected reflectivity values of the histogram for each cycle. This is analogous to finding the center of mass in a beam, except in this case, it is the center of reflectivity for each cycle. Many different methods can be used to find the moment of reflectivity. One method simply determines the most common reflectivity value, on average, when considering all of the reflectance values per cycle. Alternatively, the moment can be the average of a certain number of the most frequently detected reflectance values. For example, the moment could be the weighted average of the three most frequently detected reflectivity values, which are referred to as principle moments. The number of reflectance values to average is of course dependent upon the specific monitoring process, the wafer type, the polishing process parameters, etc. Another alternative method would simply equate the most frequently detected reflectance value with the moment.

In block 704, the principle moments can be filtered by a median filter to remove the spikes before the following curve fitting operation. In block 706, a low order polynomial curve is fit to each of the moments found in the histogram 900. Then in 708, the end point monitoring curve can optionally undergo further filtering processes for signal clarity. In block 708, the curve undergoes a one-dimensional recursive filtering process to improve the smoothness of the curve.

After generating the end point monitoring curve 1000 as represented in FIG. 10, a technique is required to determine, with a certain level of certainty, the cycle at which the polishing process is to terminate. The technique used by the algorithm involves estimating when the end point detection curve begins to move from one reflectance value to the next.

The end point will occur when the slope of the end point monitoring curve changes and the curve begins to follow a new oscillating trend. The technique for determining the process end point is represented in blocks 610 and 612.

In block 610 a non-symmetric hat function curve is generated as a reference curve with respect to the end point monitoring curve. The hat function is non-symmetric exponential with a time constant determined as a function of polishing cycle number. The hat function curve 1010, as shown by the dashed line in FIG. 10, follows the end point monitoring curve as it increases in reflectivity value, however, the hat function curve decreases in reflectively value at a slower rate when the end point monitoring curve value is less than the hat function curve value. The rate at which the hat function curve decreases becomes slower as the number of cycles increases. In this manner, the deviation between the end point monitoring curve 1000 and the hat function curve 1010 increases as the cycle number increases. This reflects the fact that the end point is not likely to be reached until certain cycles have been completed and the probability of reaching the end point is increasing as the polishing process moves on. The deviation between the end point monitoring curve 1000 and the hat function curve 1010 creates an enclosed area 1020 formed between these two curves. When the area 1020 between the deviation reaches a threshold amount and the rate at which the area increases in size reaches a threshold rate, the end point of the polishing process is determined to have been reached. It is understood that many small enclosed areas will be formed between the end point monitoring curve 1000 and the hat function curve 1010 since the end point monitoring curve 1000 decreases in value many separate times due to its fluctuating behavior. However, because of the design of hat function and formation of the enclosed areas, the values and their slopes of these earlier areas in the top oxide region have much smaller values.

The time-varying non-symmetric hat function can be represented as:

$$y^{hat}(\text{cycle})=y(\text{cycle});\ \text{when}\ y(\text{cycle})\geqq y^{hat}(\text{cycle})$$

$$y^{hat}(\text{cycle}+1)=y^{hat}(\text{cycle})*e^{(-1.0/T(cycle))};\ \text{when}\ y(\text{cycle})<y^{hat}(\text{cycle})$$

$y^{hat}$ (cycle) is the hat function curve value and y(cycle) is the value of the end point monitoring curve. T(cycle) is a non-decreasing function of polishing cycle number. One form of function T(cycle) could be T(cycle)=k*Cycle where k is a constant related to the average polishing rate for the oxide. Other linear and nonlinear forms of functions can be used to provide improved performance for different film structures. Depending upon the respective reflectivity properties of the layers to be differentiated, the second layer may have a higher or lower reflectance value. Also different STI film structure may have a sharp increase in the reflectance value at the end point region. Therefore, even though the figures of the present disclosure show that the reflectance curve drops upon detection of the second oxide layer, it is equally possible that the endpoint will be represented by a sudden increase in the reflectance curve. In this case, the hat function curve would be designed to deviate from the end point detection curve when it increases, rather than when it decreases. In practice, when the wafer film structure is given, the form of the hat function and its parameters can be determined based on the information from the film structure modeling similar to the results shown in FIG. 3, FIG. 4 and FIG. 5.

In block 612, determination of the end point from the end point monitoring curve 1000 and the hat function curve 1010 is facilitated by generating an area curve representing the size of area 1020 as a function of the number of monitoring cycles, and a slope curve representing the slope of the area curve.

Figure 11:
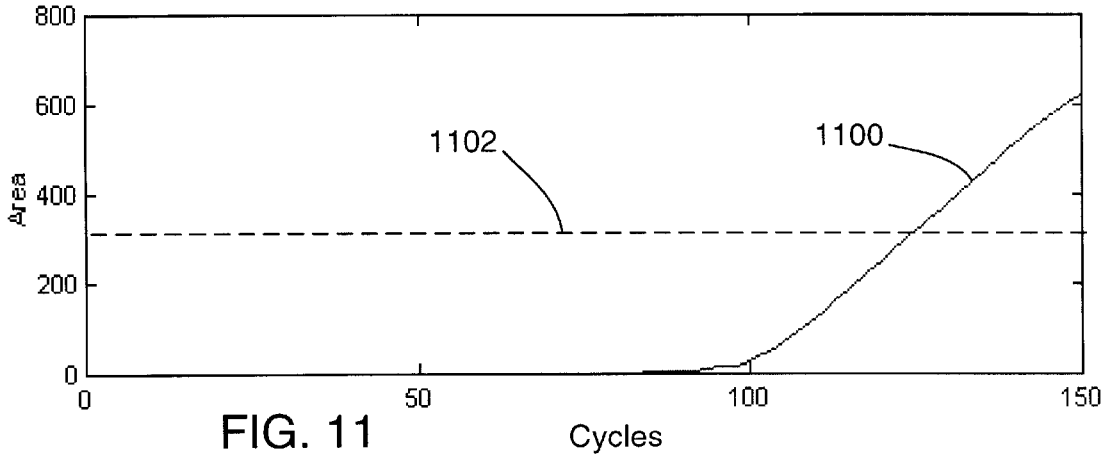
FIG. 11 illustrates an area function plotted against a horizontal axis representing the number of cycles and a vertical axis representing the size of the area.
Figure 12:
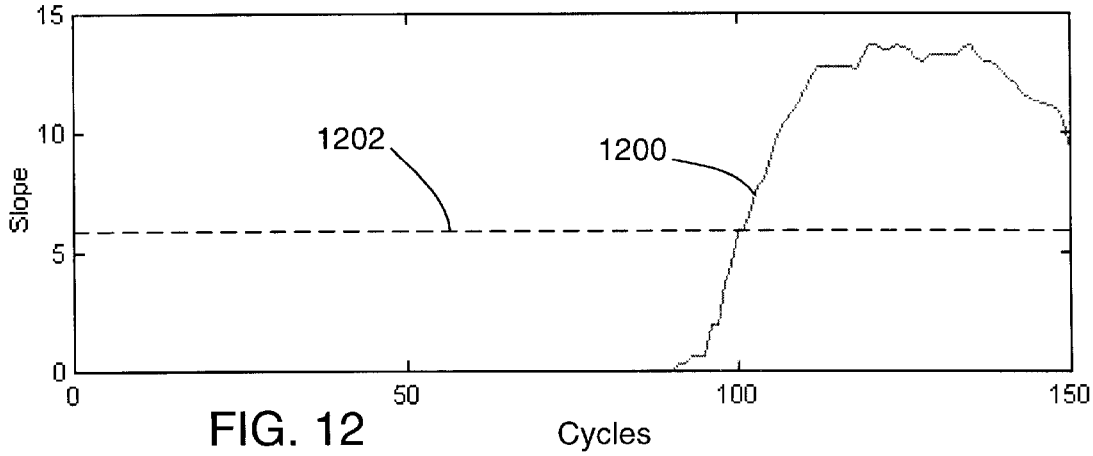
FIG. 12 illustrates a slope function graphed against a horizontal axis representing the number of cycles and a vertical axis representing the slope of the area function.

FIG. 11 illustrates an area curve 1100 plotted against a horizontal axis representing the number of cycles and a vertical axis representing the size of the area 1020. FIG. 12 illustrates a slope curve 1200 graphed against a horizontal axis representing the number of cycles and a vertical axis representing the slope of the area curve 1100.

In block 614, the end point is identified to be at the number of cycles when the area curve 1100 reaches a certain threshold area size 1102 and when the slope curve 1200 reaches a certain threshold slope value 1202. At this threshold number of cycles, the end point monitoring curve 1000 has deviated a sufficient amount from the initial reflectance value that the end point can be determined with certainty. The use of the time-varying non-symmetric hat function curve, the area and slope curves effectively improve the robustness and adaptability of the end point detection.

In alternative embodiments of the present invention, pattern and/or structure modeling/recognition techniques can be used to extract the end point information.

While this invention has been described in terms of several preferred embodiments, there are alteration, permutations, and equivalents, which fall within the scope of this invention. It should also be noted that there are many alternative ways of implementing the methods and apparatuses of the present invention. It is therefore intended that the following appended claims be interpreted as including all such alterations, permutations, and equivalents as fall within the true spirit and scope of the present invention.

We claim:

1. A method for determining a process end point during a semiconductor wafer polishing process, using a measurement system having multiple pairs of lasers and sensors, the method comprising:

scanning a beam of radiation to be incident upon each of a plurality of measurement positions on the semiconductor wafer in sequential order, the beam of radiation causing radiation to reflect off of the semiconductor wafer at each of the measurement positions;

measuring a reflectance value of the radiation reflecting off each of the measurement positions on the semiconductor wafer with each of the sensors;

recording the frequency of the reflectance values obtained by each of the sensors at each of the measurement positions;

determining an average reflectance value representing the reflectance value that was most frequently measured by the sensors wherein a sequential execution of the scanning, measuring, recording, and determining operations is referred to a monitoring cycle;

repeating the monitoring cycle to obtain additional average reflectance values, each of the additional average reflectance values obtained at a later time during the semiconductor wafer polishing process, the average reflectance values falling within an initial range of reflectance values during at least a beginning period of the polishing process; and identifying the process end point to be approximately at the time when the average reflectance values substantially begin to deviate from the initial range of reflectance values, whereby the polishing of the semiconductor wafer is terminated when the process end point has been identified.

2. A method as recited in claim 1 wherein the recording operation comprises:

placing the measured reflectance values into a three-dimensional array having a first axis representing each of the individual sensors, a second axis representing each measurement position along the wafer, and a third axis representing each monitoring cycle, wherein each measured reflectance value is associated with an associated sensor, an associated measurement position, and an associated monitoring cycle.

3. A method as recited in claim 1 wherein the recording operation comprises:

creating a histogram that illustrates the frequency of each reflectance value that is measured for each monitoring cycle.

4. A method as recited in claim 3 wherein the histogram comprises a first axis that represents the monitoring cycles and a second axis that represents the reflectance values, wherein each measured reflectance value within the histogram is color-coded to represent the frequency at which that a specific reflectance value is measured.

5. A method as recited in claim 1 wherein the operation of determining an average reflectance value comprises:

taking an average of a discrete number of the most frequently occurring reflectance values for each of the monitoring cycles.

6. A method as recited in claim 1 further comprising a polynomial curve fitting operation that follows the operation of determining an average reflectance value, the polynomial curve fitting operation comprising:

fitting a polynomial curve to the obtained average reflectance values.

7. A method as recited in claim 6 further comprising:

generating a non-symmetric hat function curve that is a function of the monitoring cycles, the value of the hat function curve decreasing at a slower rate than the polynomial curve when the value of the polynomial curve is less than the value of the hat function curve, wherein the polynomial curve and the hat function curve deviate from each other and form enclosed areas there between when the polynomial curve decreases.

8. A method as recited in claim 7 wherein the value of the hat function at a certain monitoring cycle equals the value of the hat function at a previous monitoring cycle multiplied by $e^{(-1/T(cycle))}$, wherein cycle is the number of monitoring cycles and T is a time constant determined as a non-decreasing function of the monitoring cycles.

9. A method as recited in claim 7 further comprising:

generating an area curve representing the size of one of the enclosed areas as a function of the monitoring cycles; and generating a slope curve representing the slope of the area curve as a function of the monitoring cycles.

10. A method as recited in claim 9 wherein the process end point is identified when both the area curve has reached an area threshold value and the slope curve has reached a slope threshold value.

11. A method as recited in claim 1 wherein the multiple pairs of lasers and sensors located at different angles with respect to the wafer.

12. A method for determining a process end point during a semiconductor wafer polishing process using a measurement system having multiple pairs of lasers and sensors, the process end point being the point at which a semiconductor wafer is polished until a second material is exposed through a first material, the method comprising:

repeating a monitoring cycle including the following operations, each of the monitoring cycles resulting in an associated average reflectance value, scanning a beam of radiation to be incident upon each of a plurality of measurement positions on the semiconductor wafer in sequential order, the beam of radiation causing radiation to reflect off of the semiconductor wafer at each of the measurement positions;

measuring a reflectance value of the radiation reflecting off each of the measurement positions on the semiconductor wafer with each of the sensors;

recording the frequency of the reflectance values obtained by each of the sensors at each of the measurement positions in a three-dimensional array having a first axis representing each of the individual sensors, a second axis representing each measurement position along the wafer, and a third axis representing each monitoring cycle, wherein each measured reflectance value is associated with an associated sensor, an associated measurement position, and an associated monitoring cycle;

creating a histogram that illustrates the frequency of each reflectance value that is measured for each monitoring cycle, the histogram having a first axis that represents the monitoring cycles and a second axis that represents the scaled reflectance values, wherein each measured reflectance value within the histogram is shaded a certain degree to represent a frequency at which that reflectance value is measured; and determining an average reflectance value representing the reflectance values that were most frequently measured by the sensors during a specific monitoring cycle;

fitting a polynomial curve to the obtained average reflectance values;

generating a non-symmetric hat function curve that is a function of the monitoring cycles, the value of the hat function curve decreasing at a slower rate than the polynomial curve when the value of the polynomial curve is less than the value of the hat function curve, wherein the polynomial curve and the hat function curve deviate from each other and form enclosed areas there between when the polynomial curve decreases; and identifying the process end point to be approximately at the time when the value of the polynomial curve substantially begins to deviate from the non-symmetric hat function curve, whereby the polishing of the semiconductor wafer is terminated when the process end point has been identified.

13. A method as recited in claim 12 wherein the value of the hat function at a certain monitoring cycle equals the value of the hat function at a previous monitoring cycle multiplied by $e^{(-1.0/T(cycle))}$, wherein cycle is the number of monitoring cycles and T is determined as a non-decreasing function of the monitoring cycles.

14. A method as recited in claim 12 further comprising:

generating an area curve representing the size of one of the enclosed areas as a function of the monitoring cycles; and generating a slope curve representing the slope of the area curve as a function of the monitoring cycles.

15. A method as recited in claim 14 wherein the process end point is identified when both the area curve has reached a threshold area value and the slope curve has reached a threshold slope value.

16. A method as recited in claim 12 wherein each monitoring cycle corresponds to a polishing cycle of the polishing process.

* * * * *